US005337920A

United States Patent [19]

Clausen

[11] Patent Number: 5,337,920

[45] Date of Patent: Aug. 16, 1994

[54] ROTATABLE PLATTER STORAGE AND RETRIEVAL SYSTEM

[76] Inventor: Mark K. Clausen, Box 232, Poy Sippi, Wis. 54967

[21] Appl. No.: 52,060

[22] Filed: Apr. 21, 1993

[51] Int. Cl.[5] ..... G07F 11/00

[52] U.S. Cl. ..... 221/5; 364/479; 221/76; 221/121; 221/DIG. 1; 211/163; 312/97.1

[58] Field of Search ..... 221/2, 4, 5, 7, 8, 9, 221/13, 69, 76, 132, 119-122, DIG. 1; 364/478, 479; 312/97.1, 125, 135; 194/906; 414/331, 787; 211/163

[56] References Cited

U.S. PATENT DOCUMENTS

| | | | |
|---|---|---|---|
| 2,273,948 | 2/1942 | Forslund et al. | 312/97.1 |
| 3,075,670 | 1/1963 | Brugger | 221/76 |
| 4,812,985 | 3/1989 | Hambrick et al. | 364/478 |
| 4,814,592 | 3/1989 | Bradt et al. | 235/381 |
| 4,850,658 | 7/1989 | Sandor | 211/163 |
| 4,893,727 | 1/1990 | Near | 221/81 |
| 4,945,429 | 7/1990 | Munro et al. | 360/92 |
| 5,088,604 | 2/1992 | Baur et al. | 211/163 |
| 5,226,548 | 7/1993 | Koeppel | 211/163 |
| 5,228,582 | 7/1993 | Marshall et al. | 211/163 |

*Primary Examiner*—H. Grant Skaggs

[57] ABSTRACT

A general purpose system for the storage and retrieval of articles having nested sets of rotatable platters or of various perimeters such that each set fits inside the perimeter of the next larger sized platter. All platters have storage positions or bins in which articles are stored. Bins are positioned so that one side is adjacent to the perimeter of the platter. All platters are mounted so that a part of their perimeter is adjacent to the perimeter of the platter on which they are mounted. This arrangement makes all storage positions available at the edge of the largest or main platter by rotating a subset of the smaller platters. The main platter can be rotated to a serving window making all storage positions on the platter available at the serving window. The geometry of the circular arrangement make the number of storage positions on a main platter vary with the square of the radius of the main platter whereas the time it takes to fetch a storage location varies with the radius. Smaller platters can be removed and replaced by bins allowing the system to accommodate bins with a wide variety of sizes and shapes. Several different drive assemblies can be interchangeably or redundantly mounted to rotate the platters. A computer system controls the drive assemblies to automate and optimize the storage-retrieval process. The storage system may also use rotatably mounted nested sets of support arms.

19 Claims, 11 Drawing Sheets

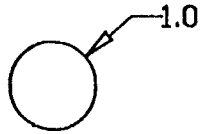
FIG 18a
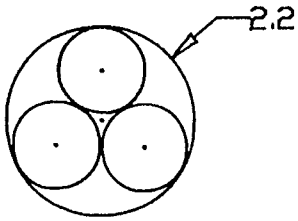
FIG 18b
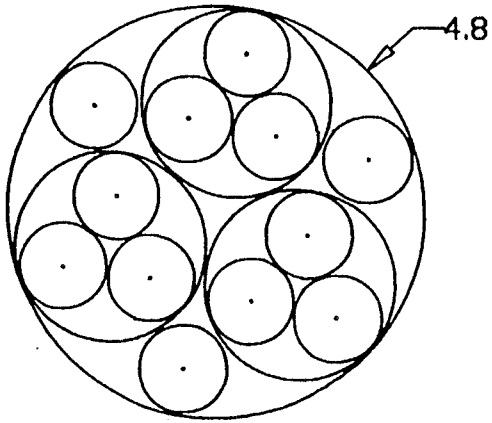
FIG 18c
| Main platter radius | 1 | 2.2 | 4.8 | 10.6 | 23.4 | 51.5 |
|---|---|---|---|---|---|---|
| Sum of perimeters | 6.3 | 20.1 | 50.5 | 117.4 | 264.6 | 588.5 |
| Number of "unit bins" | 10 | 40 | 160 | 640 | 2560 | 10240 |
| Rotatable platter fetch time (slow drive) | 10 | 34 | 85 | 197 | 443 | 986 |
| Rotatable platter fetch time (fast drive) | 10 | 22 | 48 | 107 | 234 | 515 |
| Sequential access fetch time | 10 | 40 | 160 | 640 | 2560 | 10240 |
Relative Worst Case Fetch Times
FIG 19

ROTATABLE PLATTER STORAGE AND RETRIEVAL SYSTEM

BACKGROUND—FIELD OF INVENTION

This invention relates to systems which provide for the storage and retrieval of articles.

BACKGROUND—DESCRIPTION OF PRIOR ART

Automated storage and retrieval systems are old in the art. Their utility resides in a combination of speed of storage and retrieval, space efficiency, security, and low labor costs. Such systems have found wide use in two broad categories of structures; the so called vending machine, and the automated warehouse. More recently, the mating of computers to automated storage and retrieval systems has resulted in hybrid systems now in use in some mail order and discount sales businesses.

Rotatable platter vending machines, as well as rotatable storage and retrieval systems, are quite common. U.S. Pat. No. 4,893,727 to Near (1990) and U.S. Pat. No. 4,812,985 to Hambrick et al. (1989) both show devices with circular wheels or plates which are rotated to bring the stored article to a gate or pick-and-place arm where it is made accessible to the user. Near has no provision for placing an article back into the storage area as the device is intended only as a vending machine. Neither Near or Hambrick shows a device which can handle a wide variety of articles, because neither allows a mixture of substantially different storage bin sizes or shapes. In fact, Hambrick is designed to handle only a very specific key container. Neither allows multiple storage bins to be simultaneously fetched. Neither makes use of the central part of the circular area for storage. Neither has a user adjustable mix of storage bin sizes which would allow the unit to optimize space utilization and adapt to changing storage requirements. Neither has a mixture of high and low speed store-fetch mechanisms. And finally, because of the lack of flexibility, neither would benefit from an automated, intelligent control system that maximizes space utilization and minimizes article storage and retrieval times.

U.S. Pat. Nos. 4,814,592 of Bradt et al. (1989) and 4,945,429 of Munro et al. (1990) both show circularly shaped storage systems where the stored article is stationary and the store-fetch mechanism rotates. Both, however, still have all the disadvantages cited above, with the exception that Munro uses some of the central portion of the circular area for article storage. However, the bulk of this area is still consumed by the store-fetch mechanism. Both systems are designed only for use with specific articles, in this case video and magnetic tapes, and not well suited to handle articles with a wide variety of sizes and shapes.

Another well known type of automatic storage and retrieval system is the vertical carousel. This is a sequential access system were an endless loop of containers circulate past a serving window. The main advantage of the system is that the store-fetch mechanism, which consists of an endless belt or chain, is relatively simple and takes up very little space. The result is high density, low cost storage. The main disadvantage is that the average time to fetch a randomly selected container is directly proportional to the length of the loop of containers.

All suffer from the same disadvantages:

(a) None of the circular storage systems effectively uses the center of the circular area for storage. Either the center is not used at all or is used mainly for the store-fetch mechanism.

(b) None has storage bin sizes that vary in three dimensions or allows a variety of shapes which can be intermixed to maximize utilization of storage space.

(c) None allows for the easy adjustment of the mixture of storage bin sizes and shapes, thereby allowing the storage unit to adjust to changes in storage requirements.

(d) None allows for the simultaneous fetch of multiple storage bins.

(e) None has a modular design where the same basic unit can be equipped with either a high speed or a low speed store-fetch fetch mechanism, or have both a high and low speed mechanism used simultaneously.

(f) None, except the vertical carousel, is designed so that the store-fetch mechanism uses a relatively small percentage of the total storage system space.

OBJECTS AND ADVANTAGES

Accordingly, several objects and advantages of the present invention are:

(a) to provide a system that can accommodate storage bins with a wide variety of sizes and shapes.

(b) to provide the capability to adjust the mixture of storage bin sizes and shapes as storage requirements change.

(c) to provide high density storage which uses not only the periphery of each circular storage platter, but also a large part of its central region.

(d) to provide simultaneous access to multiple storage bins.

(e) to provide a modular design that has the capability of using either a high or low speed store-fetch mechanism, or both, in a single storage system.

(g) to provide a computer control system which can optimize the utilization of storage space.

(h) to provide a computer control system which can minimize article storage and retrieval times.

(i) to provide a storage system that can be built with simple low-cost parts.

(j) to provide a storage system where the corresponding rate of increase in average store-fetch times is lower than the rate of increase in storage capacity.

Still further objects and advantages will become apparent from a consideration of the ensuing description and drawings.

DRAWING FIGURES

FIGS. 9*a* to 9*e* illustrate a series of platter rotations used to move a storage bin to the serving window.

Figure 10:
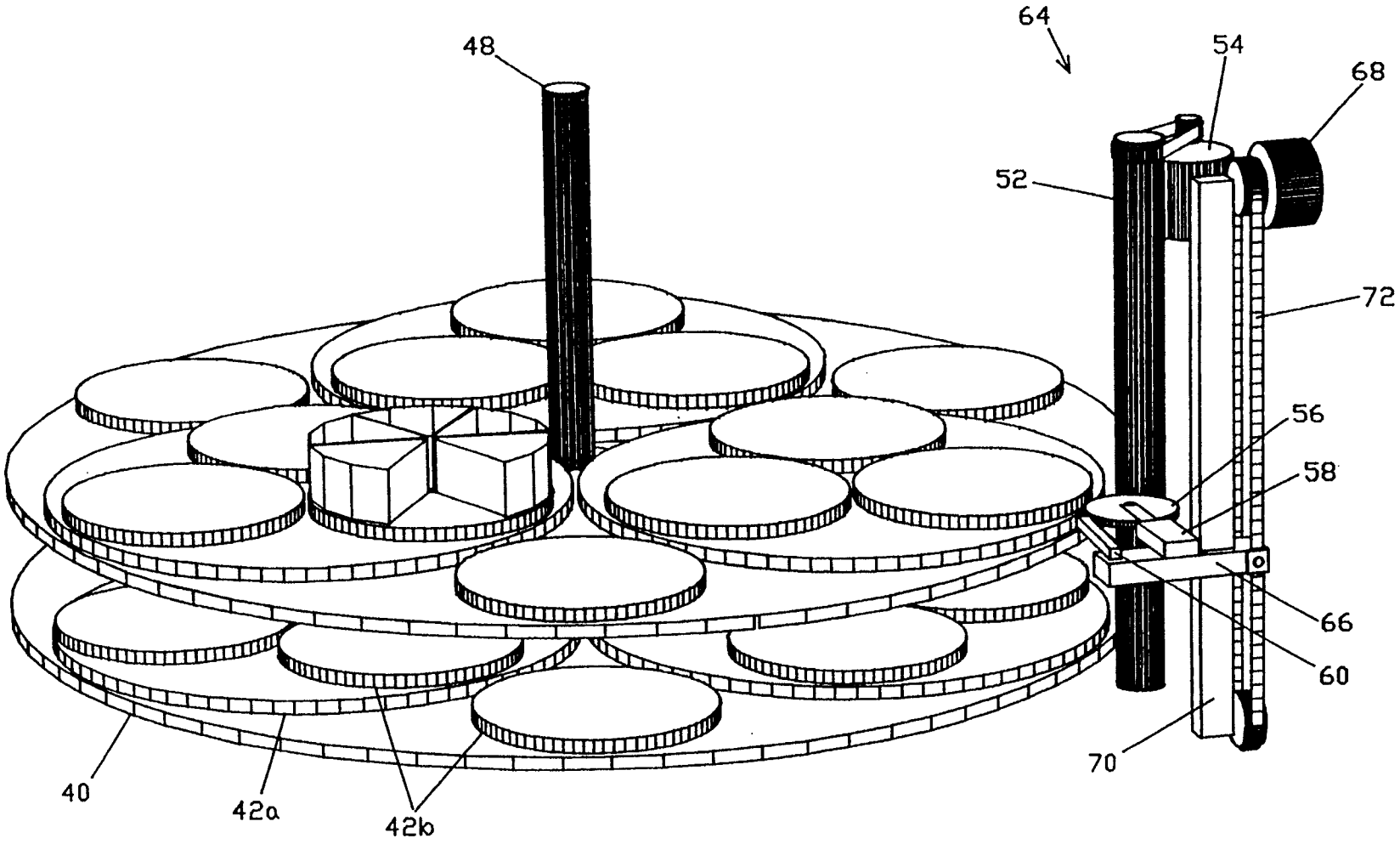

FIG. 10 is a schematic pictorial of a second embodiment of the storage system showing a single solenoid drive assembly.

Figure 11:
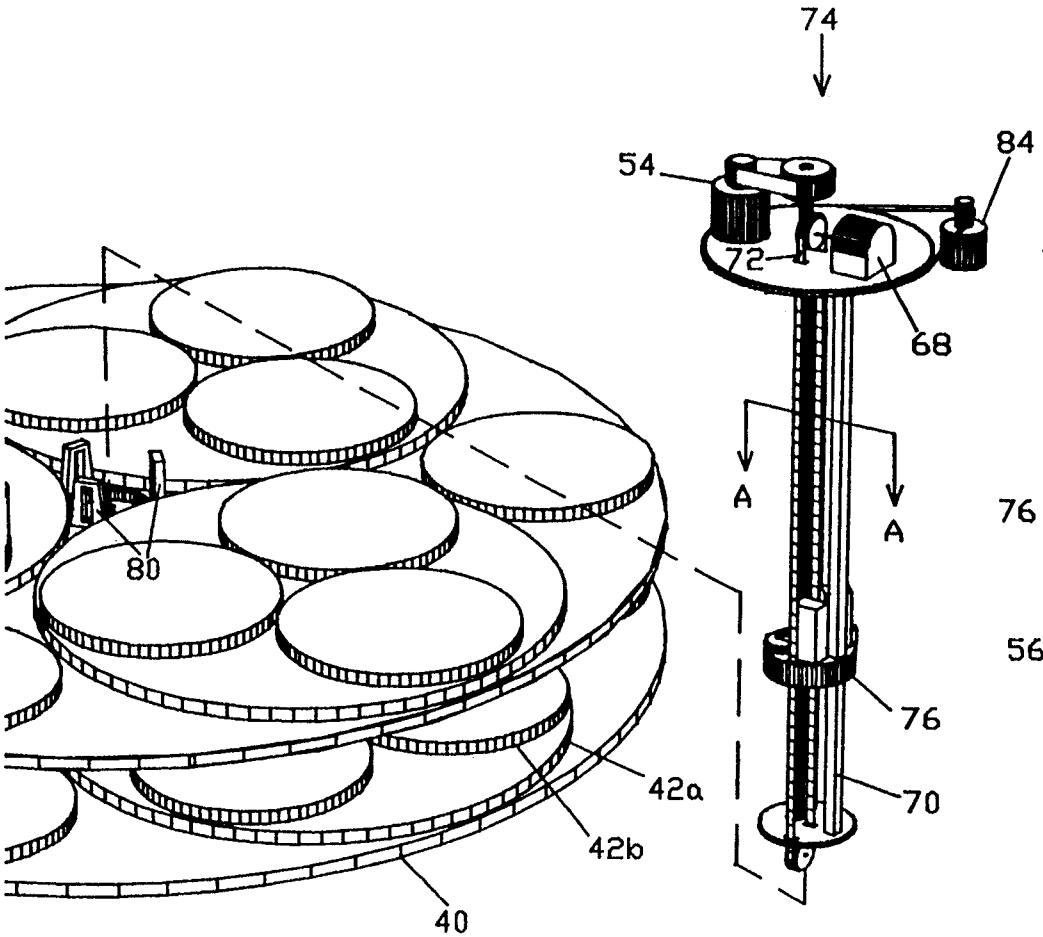

FIG. 11 is a schematic pictorial of a third embodiment of the storage system showing a center-mounted drive assembly.

Figure 12:
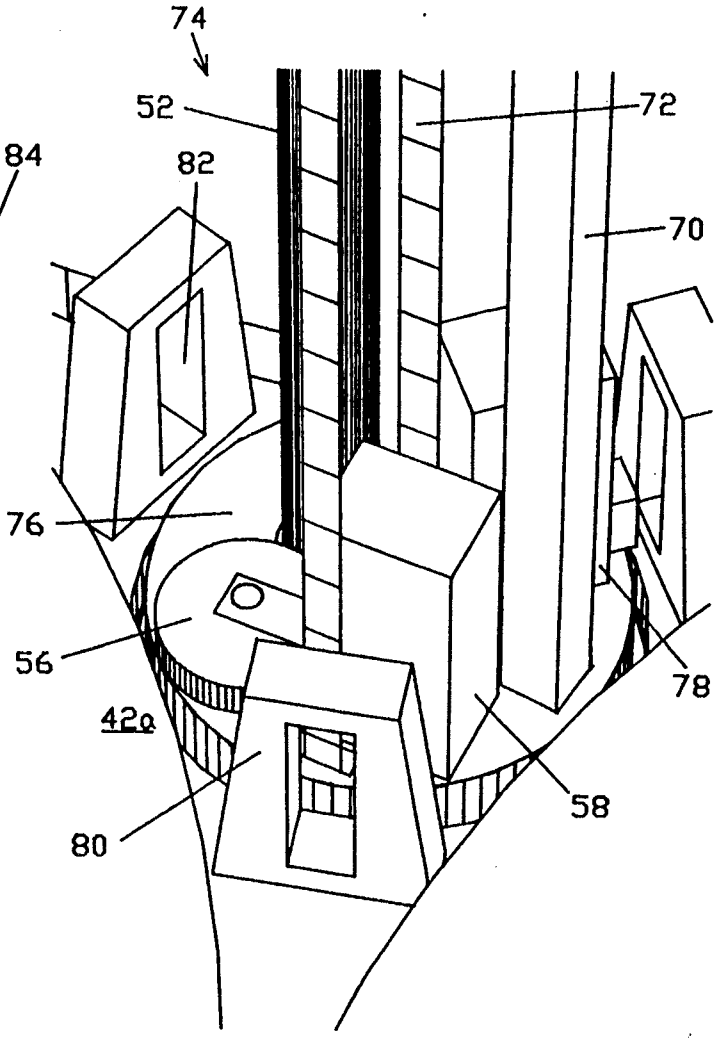

FIG. 12 is an enlarged view of the central part of a main platter of the third embodiment.

FIGS. 13*a* to 13*f* illustrate a series of platter and drive assembly rotations used by the third embodiment to move a storage bin to the serving window.

Figures 13A, 13B, 13C, 13D, 13E, 13F, 14A, 14B, 14C:
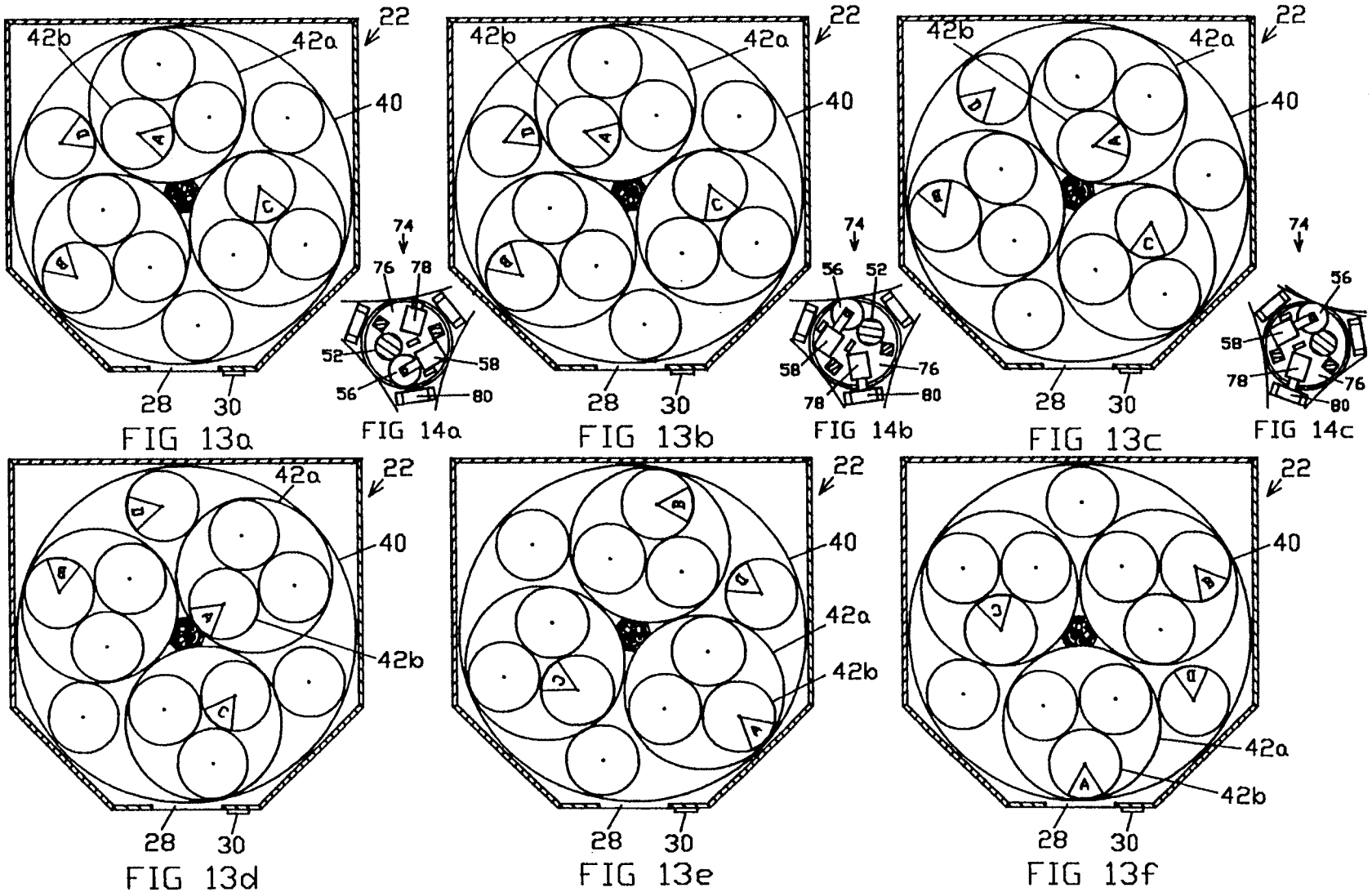

FIGS. 14*a* to 14*c* are enlarged views of the center-mounted drive assembly of FIGS. 13*a* to 13*c* respectively.

Figure 15:
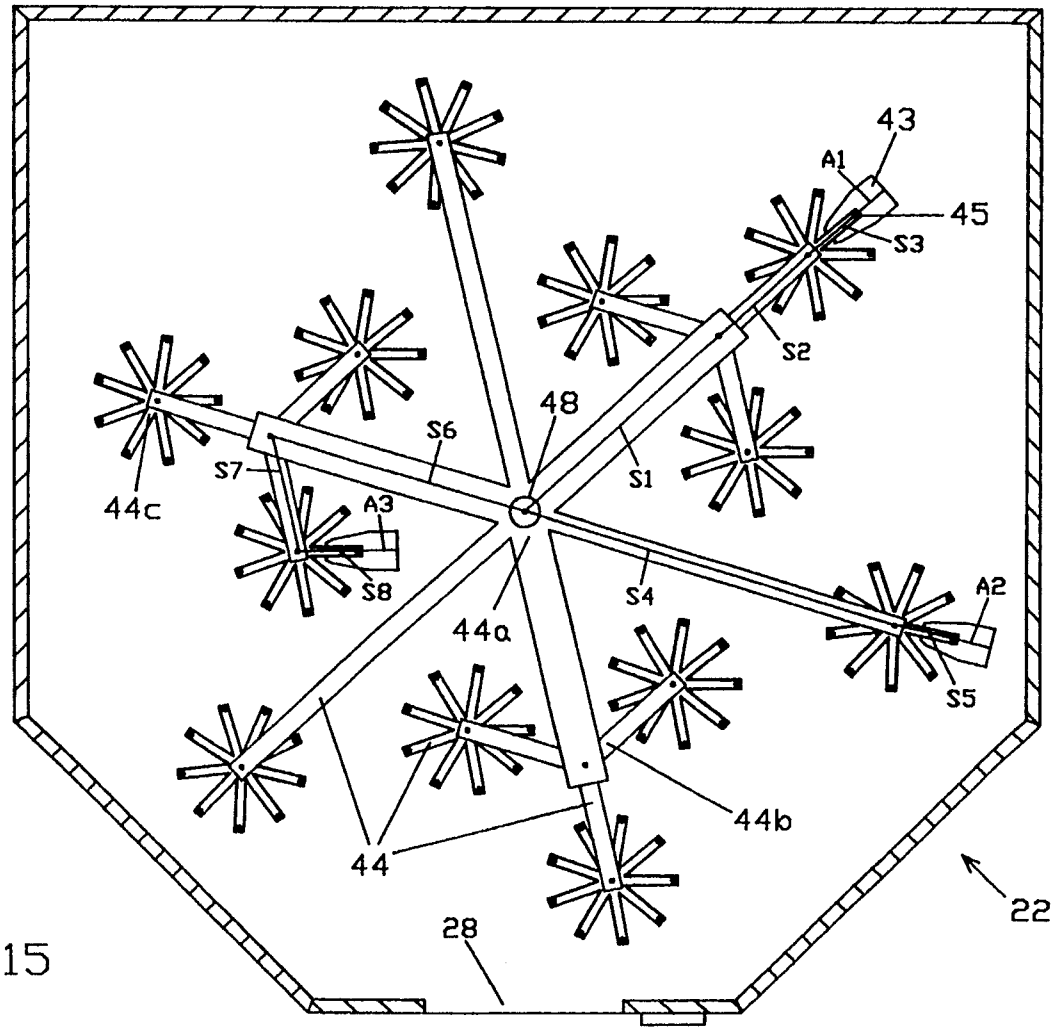

FIG. 15 is a plan view of a fourth embodiment.

Figure 16:
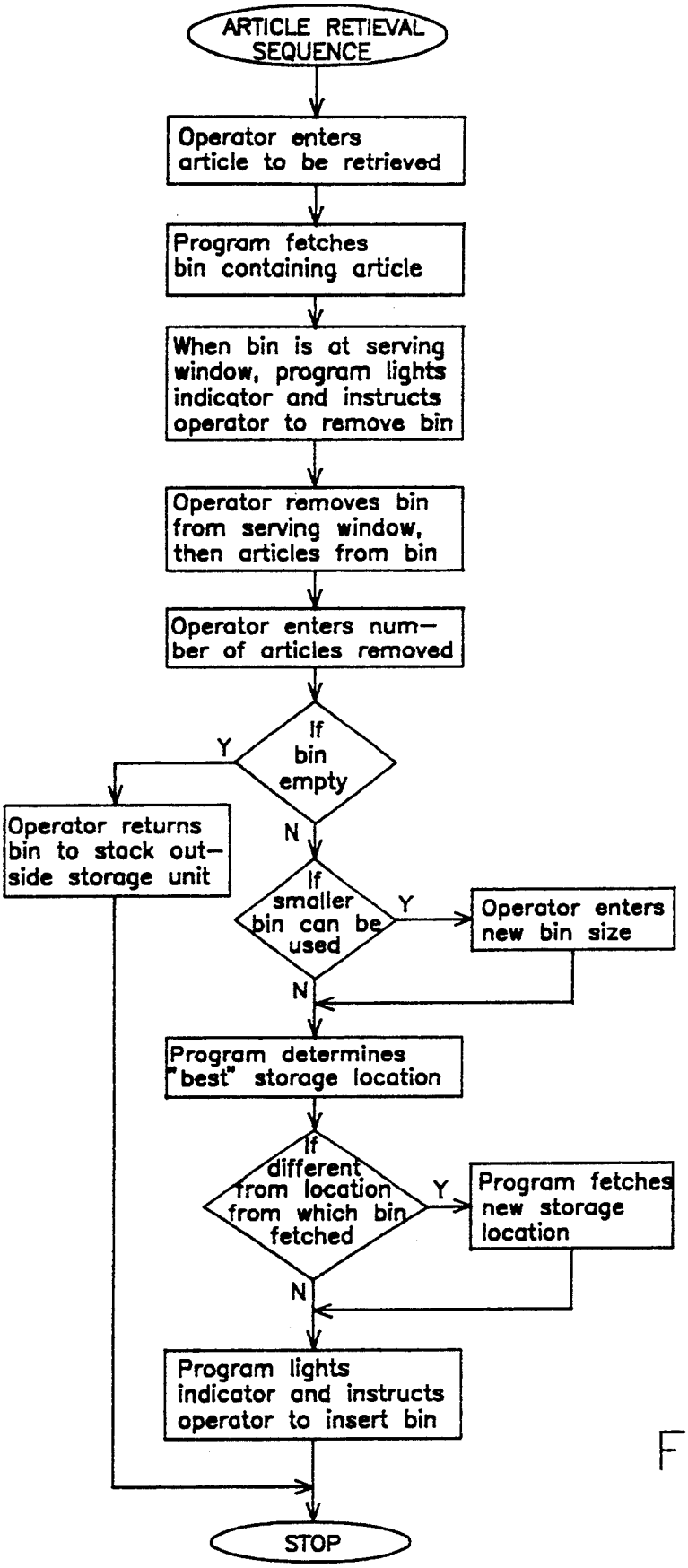

FIG. 16 is a flow diagram for an article retrieval sequence.

Figure 17:
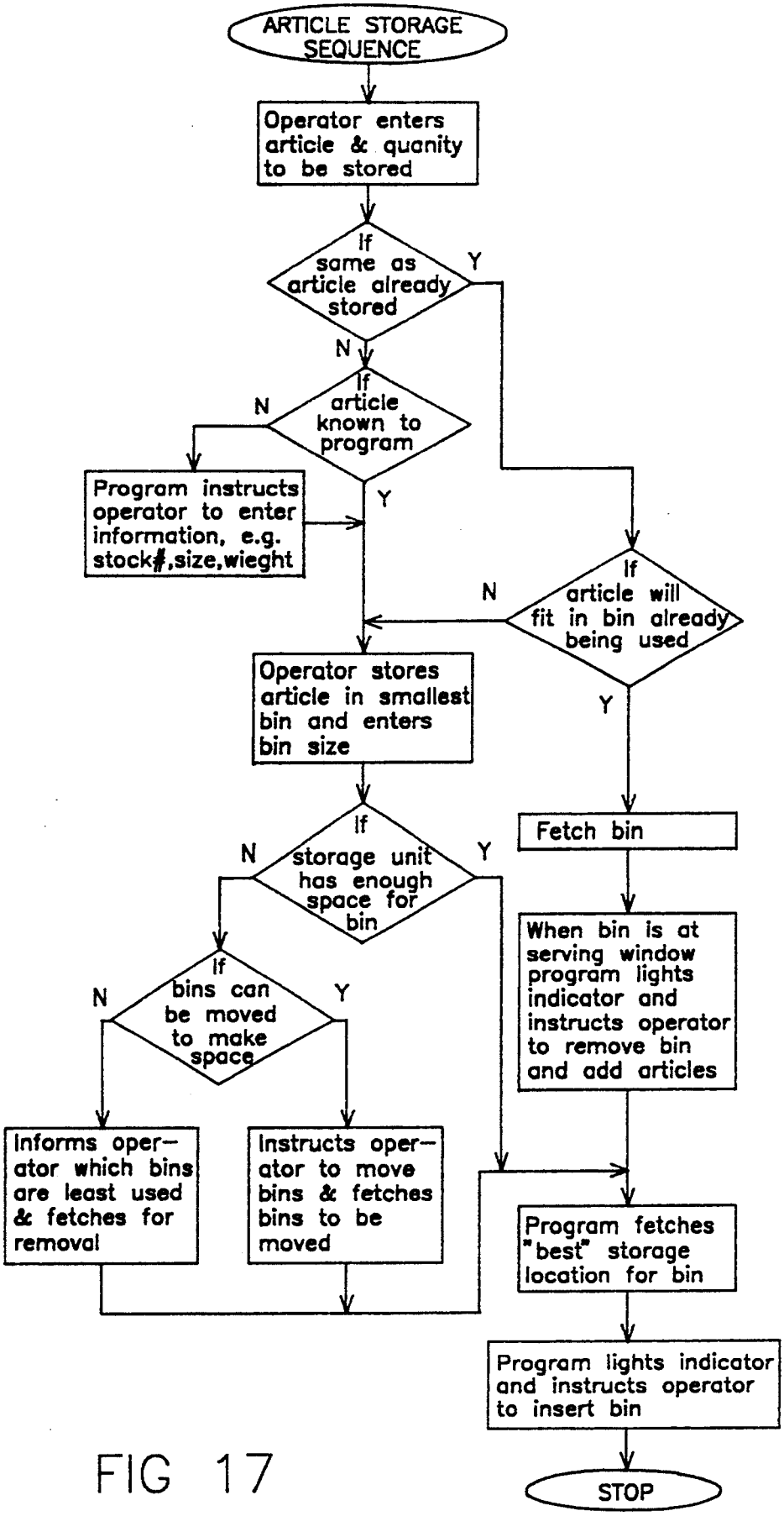

FIG. 17 is a flow diagram for an article storage sequence.

FIGS. 18*a* to 18*c* show three increasingly larger nested platter sets.

FIG. 19 is a table showing the affects of increasing storage unit size on store-fetch times.

| Reference Numerals In Drawings | |
|---|---|
| 20 storage system | 22 storage unit |
| 24 storage cylinder | 26 housing |
| 28 serving window | 30 window indicator |
| 40 main platter | 42a large subplatter |
| 42b small subplatter | |
| 43 stored article | 44 support arm |
| 44a main support arm set | 44b large nested support arm set |
| 44c small nested support arm set | |
| 45 holder | |
| 46a main platter filler bin | 46b subplatter filler bin |
| 46c small pie bin | 46d large pie bin |
| 46e irregularly shaped bin | 48 main platter support |
| 50 multiple solenoid drive assembly | |
| 52 drive shaft | 54 drive shaft motor |
| 56 idler wheel | 58 idler solenoid |
| 60 position sensor | 62 position marker |
| 64 single solenoid drive assembly | |
| 66 slide | 68 slide motor |
| 70 guide shaft | 72 belt |
| 74 center-mounted drive assembly | |
| 76 circular slide | 78 stanchion solenoid |
| 80 stanchion | 82 vertical slot |
| 84 radial alignment motor | |
| 90 computer system | 92 computer |
| 94 display unit | 96 data entry unit |
| 98 electronic control unit | 100 interface cable |

DESCRIPTION FIGS. 1–8, 10–12, 14, 15

In the drawings like numbers refer to like objects and the proportion of elements have been altered to facilitate illustration.

The drawings are schematic in that non-essential structures and elements have been omitted.

Figure 1:
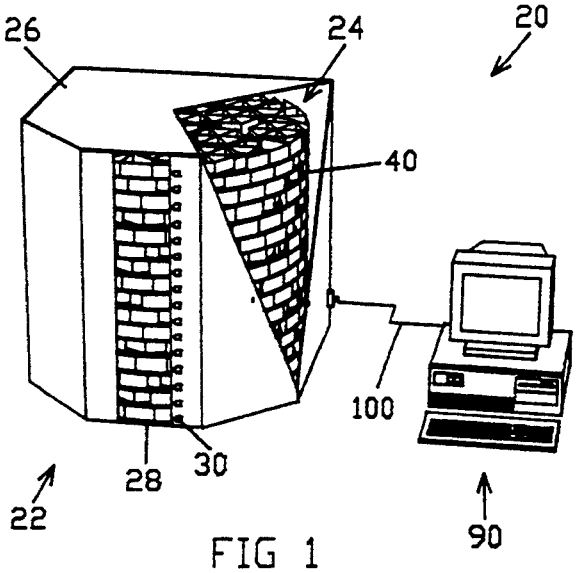
FIG. 1 is a perspective view of the storage system with part of the storage unit housing cut away.

As shown in FIG. 1, a storage system 20 comprises a storage unit 22, a computer system 90 and an interface cable 100. Storage unit 22 has a housing 26 which has been partially cut away to show a storage cylinder 24. Storage cylinder 24 consists of a stack of main support members or platters 40. Housing 26 has a serving window 28 through which articles can be stored or retrieved. Also on housing 26 and next to serving window 28 are a group of window indicators 30 which are used to tell the operator which main platter 40 contains the storage location for the article being stored or retrieved.

Figure 2:
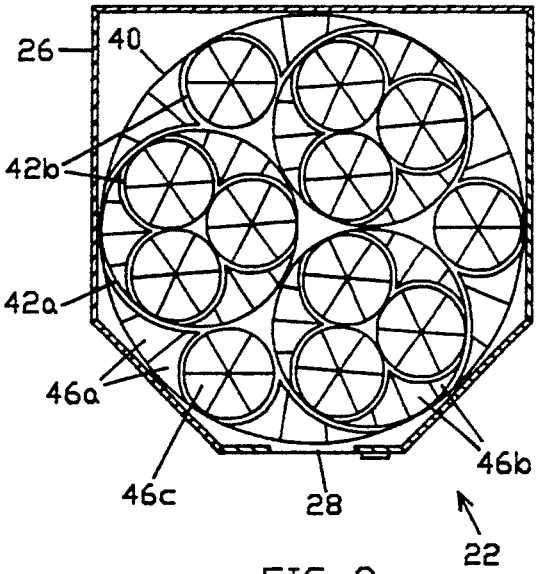
FIG. 2 is a plan view showing a main platter having multiple subplatters.

FIG. 2 is a plan view of storage unit 22 with the top of housing 26 removed and without a drive assembly which will be described below. This view shows the structure of one main support member or platter 40 which contains a set of 3 large nested support members or large subplatters 42*a* and a set of 3 smaller support members or small subplatters 42*b* which are mounted directly on main platter 40. Each subplatter 42*a* also contains a set of 3 smaller nested support members or small subplatters 42*b*. All large and small subplatters are rotatably mounted. All subplatters are positioned so that their perimeters are adjacent to the perimeter of the platter on which they are mounted. A plurality of bins 46*a*, 46*b*, and 46*c* serve to receive and dispense articles to be stored, as will be discussed in detail below. All bins can be positioned so that one of their sides is adjacent to the perimeter of platter on which they rest.

Figure 3:
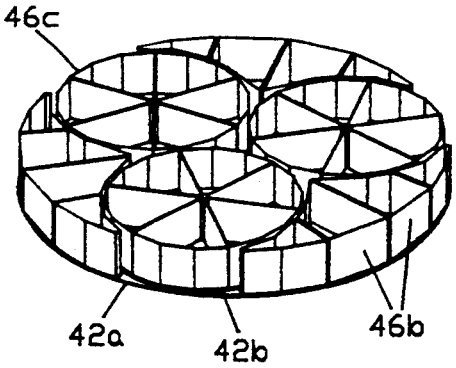
FIG. 3 is a perspective view of a large subplatter which itself contains a multiplicity of small subplatters and bins.

FIG. 3 is a perspective view showing one subplatter 42*a* which itself contains 3 subplatters 42*b* and filler bins 46*b*. Small subplatters 42*b* contain small pie bins 46*c*. Small subplatters 42*b* are rotatably mounted on large subplatter 42*a* so that an outer edge of each subplatter is adjacent to the outer edge of the large subplatter. This allows each bin 46*c* to be moved to the outer edge of the large subplatter by rotating the small subplatters. Three sets of subplatter filler bins 46*b* sit directly on large subplatter 42*a* along its outer edge.

Figure 4:
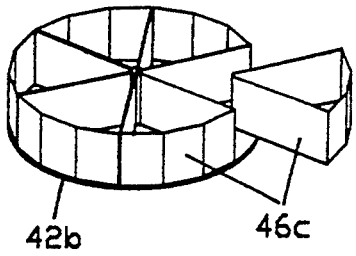
FIG. 4 is a perspective view of a small subplatter with bins.

FIG. 4 is a perspective view showing a small subplatter 42*b* which contains several pie shaped bins 46*c* which are removable. Non-removable bins (not shown), with oranges along the outer edge of subplatter 42*b* allow articles or materials to be stored and retrieved, may also be used. Non-removable bins would be appropriate when the storage unit is being used, for example, as a vending machine.

Figure 5:
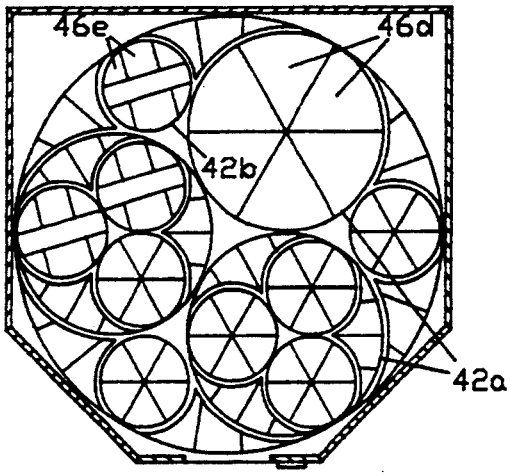
FIG. 5 is a plan view of an alternative configuration of a main platter and subplatters.
Figure 6:
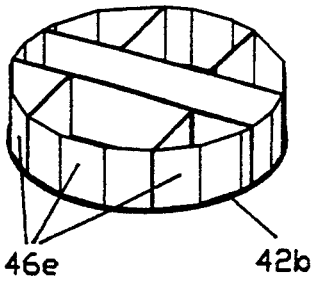
FIG. 6 is a perspective view of a small subplatter showing irregular bin shapes.

FIG. 5 shows a main platter 40 which contains 3 large subplatters 42*a*. One of the large subplatters 42*a* has had the small subplatters 42*b* removed and replaced with a set of large pie bins 46*d*. As with other bins, these larger bins 46*d* are also arranged so each is accessible from the outer edge of the subplatter on which it rests. By rotating subplatter 42*a*, each larger bin becomes accessible from the outer edge of main platter 40. FIG. 5 further illustrates how irregularly shaped bins 46*e* can be placed on subplatter 42*b*. FIG. 6 is a perspective view of irregularly shaped bins 46*e* on subplatter 42*b*.

From the description above, it can be seen that the rotatable platter storage unit can accommodate a wide variety of storage bin sizes and shapes. It is also apparent that a large proportion of the central part of the circular area is used for article storage as opposed to either being unused or used by a store-fetch mechanism. It is further apparent that by having removable bins and removable subplatters, the mix of storage bin sizes can be changed to accommodate changing storage requirements.

Figure 7:
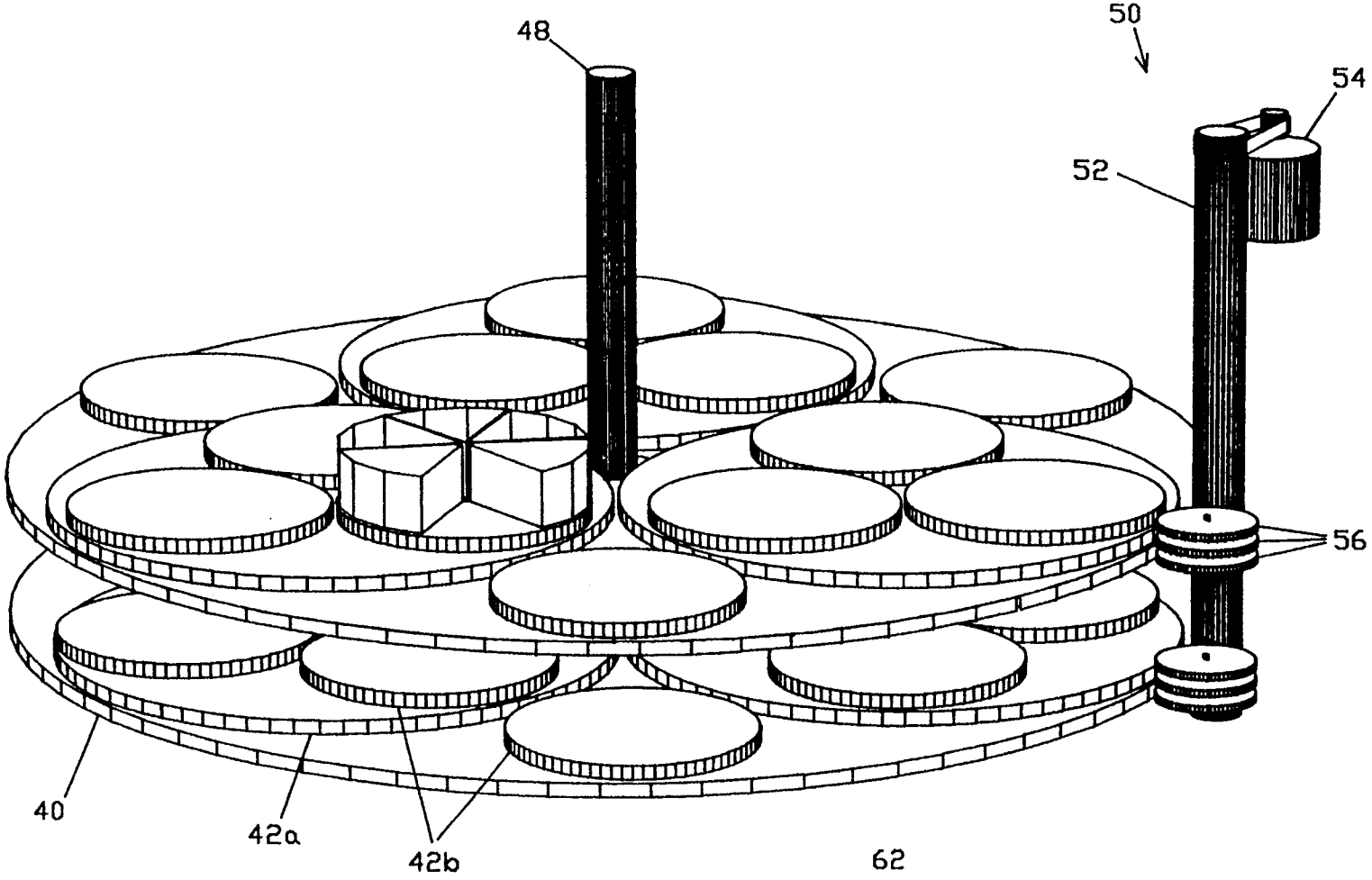
FIG. 7 is a schematic pictorial of main platters with subplatters and part of a drive assembly.

FIG. 7 is a pictorial view of a segment of the storage unit and illustrates the relationship between a multiple solenoid drive assembly 50 and the various platters 40, 42*a*, and 42*b*. Main platters 40 are supported by a main platter support 48 about which each main platter 40 can independently rotate. As described above, all subplatters are rotatably mounted. Drive assembly 50 comprises a drive shaft 52, a drive shaft motor 54, idler wheels 56, idler solenoids 58 (not shown), and position sensors 60 (not shown). Motor 54 is continually turning drive shaft 52. Idler wheels 56 have an engaged and disengaged position. In the engaged position, idler wheels 56 are placed in contact with both drive shaft 52 and either main platter 40, large subplatter 42*a*, or small subplatter 42*b*, thereby translating the motion of the drive shaft to the platter. In the disengaged position, idler wheels 56 will not be in contact with drive shaft 52 and therefore not move the platters. Position markers 62 are located along the outside edge of all rotatable platters 40, 42*a*, and 42*b*.

Figure 8:
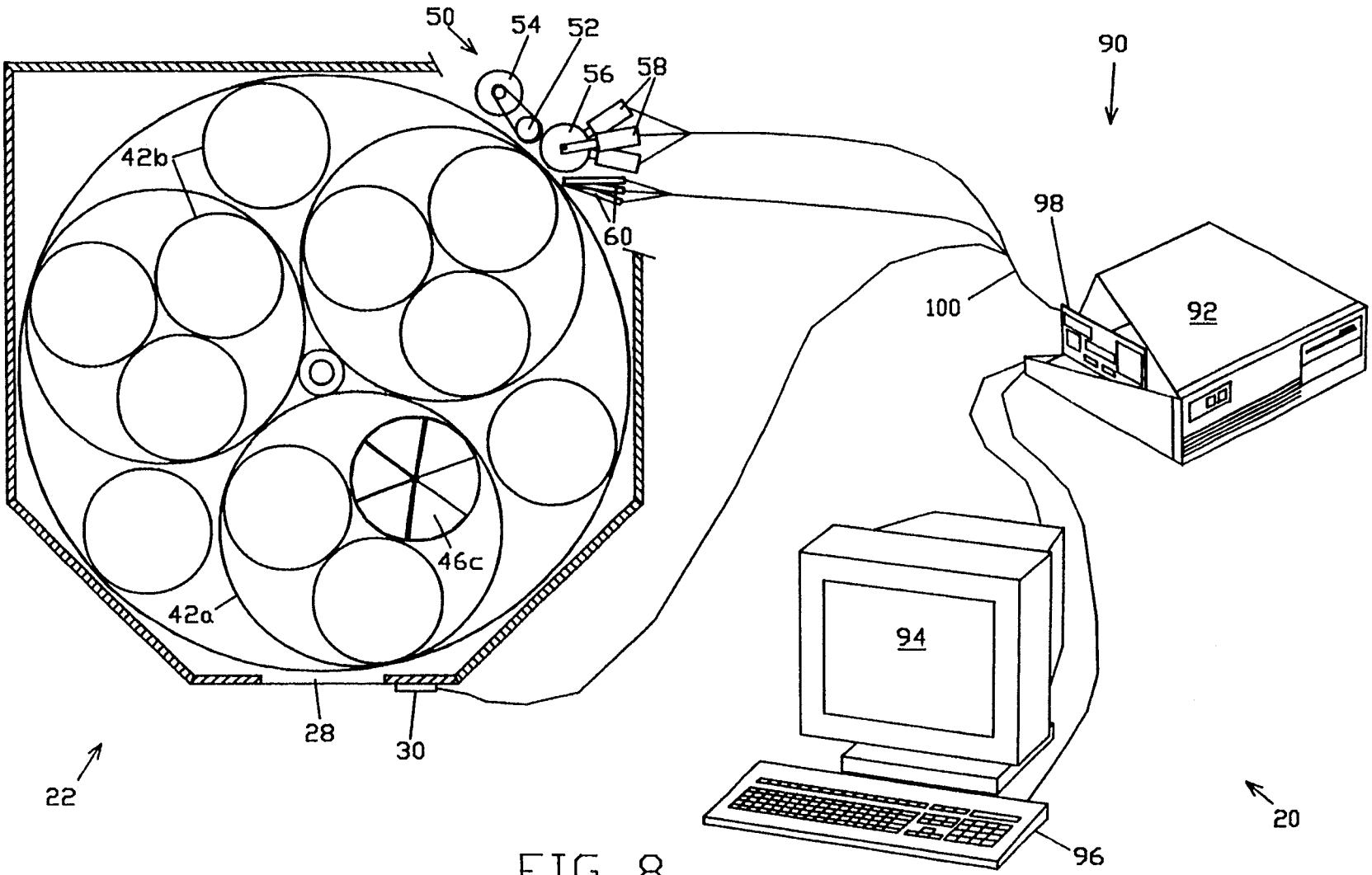
FIG. 8 is a schematic plan view showing the storage unit of FIG. 7 as it relates to a computer interface.

Referring now to FIG. 8 which is a illustrative plan view of storage unit 22 and a perspective view of computer system 90. Computer system 90 comprises a computer 92, shown with its housing partially cut away, a display unit 94, a data entry unit 96, and an electronic control unit 98. Interface cable 100 and a group of idler solenoids 58 provide the electro-mechanical connection between electronic control unit 98 and idler wheels 56. Based on operator entries made through data entry unit 96, computer 92, via electronic control unit 98, can activate any combination of idler wheels 56 to cause platter and subplatter rotation, resulting in one or more storage locations being brought to serving window 28 (as will be described in detail below). A group of position sensors 60 provide feedback information to computer system 90 by sensing position markers 62 (FIG. 7) located along the outside edge of all rotatable platters 40, 42*a*, and 42*b*. Window indicator 30, activated by computer system 90, is used to communicate to the operator that a requested bin or storage location is available at serving window 28.

From the description above it is evident that more that one store-fetch operation can occur simultaneously. This capability is particularly valuable when the storage unit has been requested to fetch a group of articles at one time, for example, when filling an order at a mail order warehouse.

Two additional embodiments of the storage unit are shown in FIGS. 10, 11, and 12. In both of these embodiments the storage unit still consists of sets of nested platters, but uses different drive assemblies. In FIG. 10 a single solenoid drive assembly 64 has only one idler wheel-solenoid-sensor set which is mounted on a slide 66. A slide motor 68, controlled by computer system 90 (not shown), a guide shaft 70, and a belt 72 are used to position the slide next to the platter to be rotated. The slide can be positioned next to any main platter or subplatter. Therefore, only a single idler wheel-solenoid-sensor set is required for the entire storage unit.

FIGS. 11 and 12 show two views of a center-mounted drive assembly 74. This embodiment also has a single idler wheel-solenoid-sensor set (sensor not shown). In this case, the components are mounted on a circular slide 76 which also contains a stanchion solenoid 78. Other components are similar to those in the previous embodiments. The main platters are not supported by a center shaft, as with the previous embodiments, but are rotatably supported along their outer edges by housing 26 (FIG. 1). Each main platter has a center hole and three slotted fixtures or stanchions 80 which are fixed to the platter and equally spaced around and adjacent to the edge of the hole. Drive assembly 74 is rotatably mounted on the storage unit housing 26 (FIG. 1) and extends down through the center hole of all main platters 40 but rotates independently of any of the platters. A radial alignment motor 84, controlled by computer system 90 (not shown), rotates the drive assembly. Circular slide 76 can be vertically positioned to horizontally align with any platter. Stanchion solenoid 78 has an engaged (FIG. 14*b*) and disengaged (FIGS. 12 and 14*a*) position. When engaged, the stanchion solenoid latches the drive assembly to one of the main platters. As can be seen in FIG. 14*b*, when the stanchion solenoid and one of the stanchions align, idler wheel 56 also aligns with one of the large subplatters 42*a*. This allows idler wheel 56 to be used for subplatter rotation in the same way it is used by the edge mounted drive assemblies of the previous embodiments. However, because center-mounted drive assembly 74 can itself rotate, the main platter and subplatter can simultaneously rotate as will be described in detail below. Simultaneous rotation results in shorter store-fetch times or, equivalently, a faster store-fetch mechanism. The center-mounted drive also has the advantage of not using space along the periphery of the main platters.

From the description above, it is apparent that the same basis rotatable platter arrangement can use several different drive assemblies. It is also apparent that the two edge mounted drive assemblies can be easily interchanged. If, for example, it is found that a single solenoid drive is not adequate, it can be replaced by a multiple solenoid drive with faster effective store-fetch times. Alternatively, a second single solenoid drive can be added, which will not only decrease the effective store-fetch times but also provide backup in case of failure. The center-mounted drive can be used for situations were shorter store-fetch times are important or space is critical. The center-mounted drive can also be augmented by either of the edge mounted drives. Modularity and flexibility are important features of the rotatable platter storage system when being used for general purpose storage, where requirements may change or not be easy to ascertain before the system is put into operation.

FIG. 15 is a illustrative plan view of yet another embodiment of storage unit 22. This embodiment uses groups or sets of support arms rather than platters for its means of storage. A set of the largest arms constitute a main support arm set 44*a* which consists of several different sizes of support arms 44. A set of the smaller arms constitute a large nested support arm set 44*b*, and a set of still smaller arms constitute a small nested support arm set 44*c*. Each support arm is equipped, at its outer end, with an attachment mechanism or hook or holder 45 so that it can support either a smaller nested set or article 43. As with platters, all nested sets are rotatably mounted. The main set 44*a* is rotatably mounted on the main support 48. By rotating nested sets, any stored article can be brought to the outer perimeter of the storage unit, and by rotating the main set, the article can be brought to serving window 28. Each stored article has an associated storage path, or line from main support 48 to article 43. The rule for constructing the nested sets is that the length of the storage paths (summation of support arm lengths and article length) must be equal; which allows all articles to be brought to the storage unit's outer perimeter. For example, FIG. 15 shows three storage paths S1+S2+S3+A1, S4+S5+A2, and S6+S7+S8+A3, all of which are of equal length.

It should now be appreciated that rotatable platters can easily be replaced by sets of rotatable support arms and still maintain the same advantages of simplicity, high storage density and fast store-fetch times of the previous embodiments. The support arms would be better suited for hanging storage as for clothes in a laundry and dry cleaning shop. The system could be used manually or with power assistance by using a motor to rotate each support arm set.

OPERATION—FIGS. 9, 13, 14, 16, 17

FIGS. 9*a* to 9*e* are a series of plan views of storage unit 22 which show how a specific bin is brought to serving window 28 using multiple solenoid drive assembly 50. The specific bin being fetched is labeled "A". Other bins have also been labeled to illustrate which platters do not rotate.

Figure 9C:
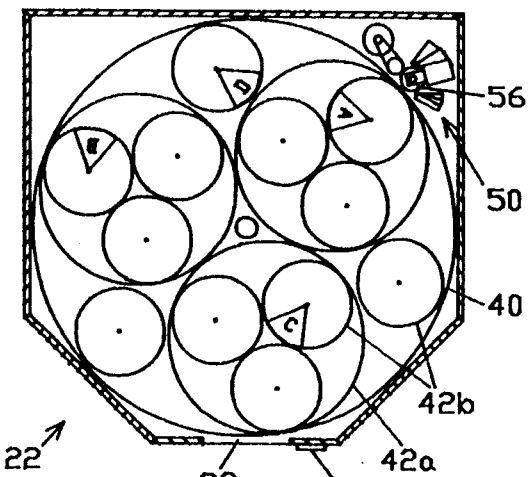
Figure 9B:
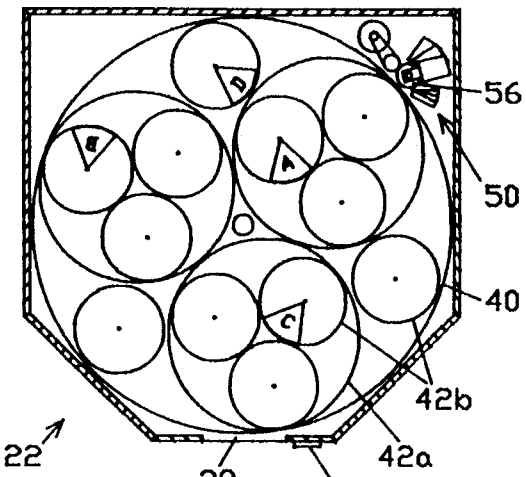
Figure 9E:
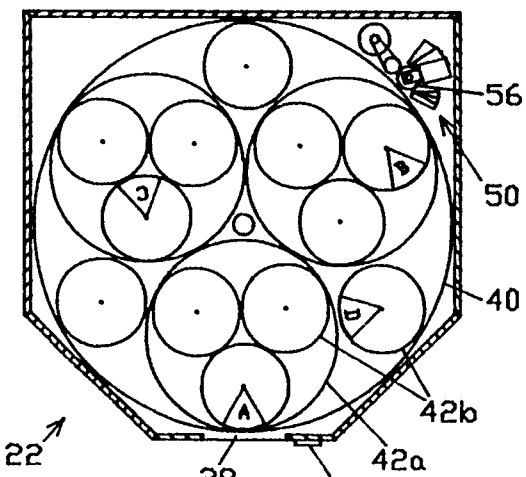
Figure 9A:
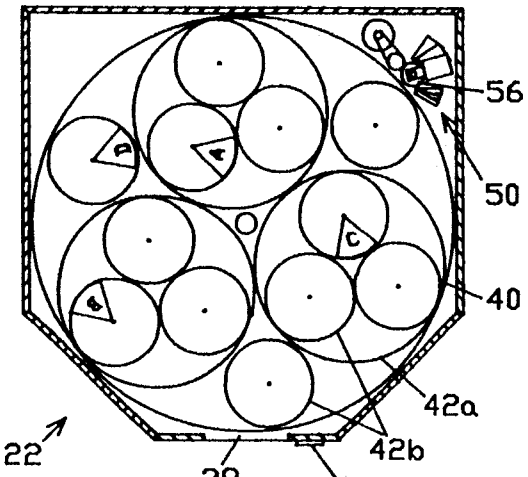
Figure 9D:
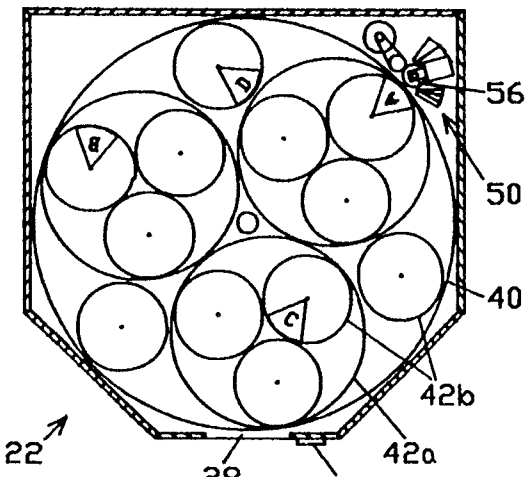

In FIG. 9*a* bin A is at a remote location on main platter 40. The idler wheel 56 that is in horizontal alignment with main platter 40 engages. Main platter 40 rotates to bring the large subplatter 42*a* on which bin A is located into radial alignment with drive assembly 50, as illustrated in FIG. 9*b*. The main platter idler wheel then disengages and the idler wheel that is in horizontal alignment with large subplatter 42*a* engages. Subplatter 42*a* then rotates until the small subplatter 42*b* on which bin A is located aligns with drive assembly 50, as illustrated in FIG. 9*c*. The large subplatter idler wheel disengages and the idler wheel that is in horizontal alignment with small subplatter 42*b* engages. Subplatter 42*b* rotates until bin A is along the outer edge of main platter 40, as is illustrated in FIG. 9*d*. The small subplatter idler wheel disengages and the idler wheel that is in horizontal alignment with main platter 40 engages. Main platter 40 then rotates until bin A is aligned with serving window 28, as shown in FIG. 9*e*. Window indicator 30 activates to advise the operator that bin A is available for article storage or retrieval. Although the above description has been for a single main platter, because the multiple solenoid drive assembly has a separate idler wheel-solenoid-sensor set for each platter and subplatter, operations on other main platters can occur simultaneously.

From the description of the bin fetch sequence above, it is obvious that to bring any bin to the serving window requires, at the most, the rotation of only the main platter, one large subplatter, and one small subplatter. It is apparent that the worst case store-fetch time will be directly related to the total length of the perimeters of the three platters (worst case being when all would have to make nearly a complete revolution). It is also apparent that compared to continuous loop store-fetch systems, on average far fewer intervening bins must be moved past the serving window to get to the desired bin. This is an important feature of the rotatable platter storage system because it has both the simplicity and storage density associated with continuous loop systems (e.g. vertical carousel) but does not have the disadvantage of long store-fetch times.

The operation of single solenoid drive 64 (FIG. 10) is the same as described above for multiple solenoid drive 50. However, before the idler wheel engages, slide motor 68 (FIG. 10) must vertically reposition slide 66 (shown in FIG. 10 and containing the idler wheel-solenoid-sensor set) to be in horizontal alignment with the platter to be rotated. Also, because only a single idler wheel is available, only one store-fetch operation can be occurring at a time.

FIGS. 13*a* to 13*f* and 14*a* to 14*c* are a series of plan views of storage unit 22 which show how a specific bin is brought to serving window 28 using center-mounted drive assembly 74. The drive assembly is shown in a sectional view along line A—A of FIG. 11. FIGS. 14*a* to 14*c* are enlarged views of the central part of FIG. 13*a* to 13*c* respectively. The specific bin being fetched is labeled "A". Other bins have also been labeled to illustrate which platters do not rotate.

FIG. 13*a* shows bin A at a remote location. FIGS. 13*a* and 14*a* show that stanchion solenoid 78 is not radially aligned with stanchion 80 on main platter 40. FIG. 13*b* shows that none of the platters has moved; however, FIG. 14*b* shows that center-mounted drive assembly 74 has rotated to bring solenoid 78 into radial alignment with the stanchion 80 that is directly opposite subplatter 42*a* containing bin A. During this rotation, slide motor 68 (FIG. 11) also vertically repositions circular slide 76 so that it is in horizontal alignment with main platter 40. Stanchion solenoid 78 is then aligned, both radially and horizontally, with the stanchion opposite the subplatter. The stanchion solenoid engages, locking drive assembly 74 to the main platter. Idler wheel 56, now also both radially and horizontally aligned with the subplatter, also engages to start the rotation of the subplatter. At the same time, drive assembly 74 and the main platter, being locked together, start rotating to bring large subplatter 42*a* with bin A to serving window 28. Large subplatter 42*a* rotates to bring small subplatter 42*b* with bin A to a position which places it in radial alignment with idler wheel 56, as shown in FIG. 13*c* and 14*c*. It should also be noted that FIG. 13*c* shows that the main platter has rotated. Idler wheel 56 disengages and slide motor 68 (FIG. 11) repositions the idler wheel vertically to be in horizontal alignment with small subplatter 42*b*. Stanchion solenoid 78 remains engaged and slides in a vertical slot 82 (FIG. 12) of stanchion 80. The idler wheel re-engages and the small subplatter rotates until bin A is on the outer edge of the large subplatter as shown in FIG. 13*d*. The main platter has continued to rotate. The idler wheel then repositions back to the large subplatter. The large subplatter rotates until bin A is on the outer edge of the main platter as shown in FIG. 13*e*. The idler wheel then disengages and the main platter continues to rotate bringing bin A to the serving window as shown in FIG. 13*f*.

It now becomes more apparent how the center-mounted drive assembly interacts with the main platters and subplatters. It is also apparent that the main platter and subplatter can simultaneously rotate. Simultaneous rotation results in shorter store-fetch times or, equivalently, a faster store-fetch mechanism.

FIG. 16 and FIG. 17 are flow diagrams that show the logic of computer programs installed in computer system 90 (FIG. 8). The programs are used to interact with the operator and with storage system 20 (FIG. 8) to control the storage and retrieval of articles. The flow diagrams illustrate how computer program logic is used to maximizing the utilization of storage space and to minimizing article storage and retrieval times. These two considerations are far more important for the rotatable platter storage system then for systems in the prior art for two reasons; first, none of the prior art systems can accommodate such a wide variety of bin sizes and shapes, and second, none of the prior art systems have multiple speed store-fetch mechanisms available in a single housing. This extra flexibility is a very significant feature of the present invention and sets it apart from the prior art. In addition, this extra flexibility is significantly enhanced by programs of the type illustrated by the flow diagrams shown in FIGS. 16 and 17.

THEORY OF OPERATION FIGS. 18, 19

The most important feature of the rotatable platter storage system is that it is based on the geometry of the circle. As is well known, the area of the circle varies as the square of the radius ($A=3.14\times R\times R$) and the circumference or perimeter directly with the radius ($C=2\times 3.14\times R$). For the rotatable platter system, the number of "unit bins" that can be stored on a main platter closely relates to its area and the store-fetch time for a bin closely relates to the main platter's perimeter. It follows that as the size of a main platter increases, its fetch time increases as a function of the radius and its storage capacity increases as a function of the square of the radius. This is illustrated in the table of FIG. 19 where a series of increasingly larger platters has been analyzed. For ease of comparison, each larger platter uses the previous main platter as its largest subplatter. The first three platter sizes are shown in FIGS. 18*a*–18*c*. The table shows data for a series of 6 increasingly larger sizes. The radius increases by 2.2 for each step. The number of "unit bins" has been estimated (by counting subplatters and estimating an equivalent "unit bin" size for the filler bins) to increase by four with each platter increase. The smallest platter has been given a radius of 1, has 10 "unit bins" and a worst case store-fetch time of 10 "time units" (a nearly complete rotation of the platter past the serving window at a rate of 1 "time unit"/-"unit bin"). The assumption has been made that the amount of time for the drive assembly to switch between platters is small compared to actual rotation time. It is also assumed that platters rotate in only one direction. The "slow drive" is an edge mounted drive of the first two embodiments. The drive has been assumed to be offset from the serving window by 36 degrees. The "fast drive" is the center-mounted drive of the third embodiment.

In a continuous loop or sequential access (e.g. vertical carousel) system, the worst case store-fetch time would be the time it takes to move the entire loop of "unit bins" past the serving window. The assumption is that the loop circulates in only one direction (which is equivalent to the assumption used above for platters). Therefore, as shown in the table of FIG. 19, the worst case times are equal to the number of "unit bins."

It is obvious from the table in FIG. 19 that the rotatable platter storage system offers significant speed advantages over continuous loop systems. This is an important feature of the present system in that it closely matches the continuous loop system's advantages of simplicity of operation and high storage densities but not its major disadvantage of slow store-fetch times.

SUMMARY, RAMIFICATIONS, AND SCOPE

Accordingly, the reader will see that the rotatable platter storage system of this invention can accommodate bins with a wide variety of sizes and shapes. In addition, the mixture of bin sizes and shapes can be adjusted to meet changing storage requirements. The ability to add or remove subplatters greatly enhances the range of bin sizes the system can handle. A primary advantage of being able to adjust the storage bin sizes to meet storage requirements is the ability to make the best use of storage space, or, in other words, to maximize storage densities. However, two other factors also contribute to high storage densities: one, the use of much of the central portion of each platter, and two, the fact that the store-fetch mechanism uses very little space.

Another major advantage of the present system, when compared to continuous loop, sequential access systems (e.g. vertical carousel), is reduced store-fetch times. This is true because the store-fetch time is a function of the summation of the circumferences of the main platter and all subplatters that must be rotated to bring a container to the serving window, whereas the storage area is a function of the square of the main platter radius.

Another advantage of the present system is that several different drive mechanisms can be used with the same basic storage unit. The ability to exchange one drive type for another, or to use two of one drive type in tandem, or to use a mixture of drive types in one system, greatly increases the system flexibility.

Yet another advantage is that the system is straightforward and uncomplicated and can be built with simple, low-cost parts.

Although the description above contains many specificities, these should not be construed as limiting the scope of the invention but as merely providing illustrations of some of the presently preferred embodiments of this invention. For example, several serving windows could be spread around the storage unit allowing several people to be using the system simultaneously. This would be useful for "automatic pick" systems. Multiple serving windows could also be of different sizes to match differently sized bins. An arm could be added to retrieve bins from higher windows so the storage unit's height would not be limited by the height of the operator. The storage unit could be used so that the platters rotated in the vertical, rather than the horizontal, plane, with the serving window along the bottom of the unit. With this arrangement the bins could be fixed to the platters and designed for bulk dispensing using a gravity feed mechanism. The feature of having removable subplatters could allow the unit to be restocked a platter at a time rather than having to restock individual bins. This could be especially valuable if the unit were being used as a vending machine.

Thus the scope of the invention should be determined by the appended claims and their legal equivalents, rather than by the examples given.

I claim:

1. A storage and retrieval unit comprising:

(a) A plurality of support members, each said support member having a generally circular perimeter, said plurality of support members comprising at least one main support member and a plurality of nested support members, said nested support members being of a plurality of sizes and being smaller than said main support member, each said nested support member being rotatably mounted on a larger said support member such that the perimeter of said nested support member is adjacent to the perimeter of the support member on which it is mounted and where at least several of said nested support members are smaller than a larger nested support member and are co-mounted on said larger nested support member in such a way that all are approximately circumscribed by the perimeter of said larger nested support member on which they are mounted;

(b) a multiplicity of storage means for storing articles, said storage means supported by said support members, said storage means being positioned so that a part of each said storage means is adjacent to the perimeter of the support member by which said storage means is supported;

(c) a main support member support means for supporting said main support members, each said main support member being rotatably mounted on said main support member support means;

(d) at least one serving position at which articles are stored or retrieved, said serving position located adjacent to the perimeter of said main support members.

2. A storage and retrieval unit according to claim 1 wherein said storage means are individually accessible and have a variety of sizes and shapes.

3. A storage and retrieval unit according to claim 2 wherein said storage means can be individually removed from and replaced on said support members so that said storage means that have been removed can be replaced by said storage means of other sizes and shapes whereby the mixture of sizes and shapes of said storage means can be adjusted to meet changing storage requirements and optimize utilization of storage space.

4. A storage and retrieval unit according to claim 2 wherein said nested support members can be removed and replaced by said storage means and said storage means can be removed and replaced by said nested support members whereby the mixture of sizes of said storage means can be adjusted to meet changing storage requirements.

5. A storage and retrieval unit according to claim 1 further comprising a drive means to rotate said main support members and said nested support members of any size whereby any said storage means can be brought to said serving position.

6. A storage and retrieval unit according to claim 5 wherein said drive means comprises a drive shaft means, a multiplicity of idler wheel means, and a multiplicity of solenoid means whereby a single said drive shaft means is used to rotate said main support members and said nested support members to bring said storage means to said serving position.

7. A storage and retrieval unit according to claim 5 wherein said drive means comprises a main support member drive means for rotating said main support members and a nested support member drive means for rotating said nested support members, where said nested support member drive means moves in radial synchronization with said main support member whereby said nested support members and said main support member can be simultaneously rotated thereby providing faster access to said storage means.

8. A storage and retrieval unit according to claim 5 further comprising:

(a) a computer system having a data storage file, a data entry unit, and a display unit;

(b) an electronic control unit for translating commands generated by computer software to electrical signals that control said drive means;

(c) an interface means for carrying the signals between said electronic control unit and said drive means.

9. A storage and retrieval unit according to claim 8 further comprising a position sensing means which further comprises a set of position marks on said support members and a set of position sensors capable of reading said position marks whereby position information can be returned to said computer system.

10. A storage and retrieval unit according to claim 8 further comprising a software control module that resides in said computer system and interacts with said electronic control unit wherein the operator can enter the name of an article and said software control module will command said drive means to fetch said storage means containing said article.

11. A storage and retrieval unit according to claim 8 further comprising an optimization means for interaction with the said storage and retrieval unit to reposition said storage means on said support members so as to increase space utilization and minimize average article storage and retrieval times.

12. A storage and retrieval unit according to claim 1 further comprising a housing which encloses said support members except for an opening which allows access through said housing to said serving position.

13. A storage and retrieval unit according to claim 1 wherein said main support members are stacked to form a storage cylinder of independently rotatable said main support members.

14. A storage and retrieval unit according to claim 13 further comprising a drive means to rotate said main support members and said nested support members whereby any said storage means can be brought to said serving position.

15. A storage and retrieval unit according to claim 14 wherein said drive means comprises a drive shaft means, a multiplicity of idler wheel means, and a multiplicity of solenoid means whereby a single said drive shaft means is used to rotate one or more said support members to bring said storage means to said serving position.

16. A storage and retrieval unit according to claim 14 wherein said drive means comprises a main support member drive means for rotating said main support members and a nested support member drive means for rotating said nested support members, where said nested support member drive means rotates in radial synchronization with said main support member whereby said nested support members and said main support member can be simultaneously rotated thereby providing faster access to said storage means.

17. A storage and retrieval unit comprising:

(a) A plurality of support arm sets, each said support arm set further comprising several support arms which are radially connected and where said support arms are of one or more sizes, each said support arm having an outer end which is longitudinally opposite the end at which it is radially connected, said plurality of support arm sets comprising at least one main support arm set and a plurality of nested support arm sets, said nested support arm sets being of a plurality of sizes and being smaller than said main support arm set, each said nested support arm set being rotatably mounted on said outer end of a support arm which is part of a larger said support arm set and where at least several of said nested support arm sets are smaller than a larger nested support arm set and are co-mounted on said larger nested support arm set;

(b) a main support arm set support means for supporting said main support arm sets, each said main support arm set being rotatably mounted on said main support arm set support means;

(c) a multiplicity of article holder means for storing articles located on said outer end of said support arms and to which articles being stored are attached where each said article holder means is at the end of a support path where said support path comprises a subset of said support arms from said main support arm set support means to said article holder means, where the length of said support path is sufficiently long so that rotation of said nested support arm sets that contain said support arms of said support path will bring the stored article to the outer perimeter of the storage unit;

(d) at least one serving position at which articles are stored or retrieved, said serving position located adjacent to the outer perimeter of the storage unit.

18. A storage and retrieval unit comprising:

(a) A plurality of support members, each said support member having a generally circular perimeter, said plurality of support members comprising at least one main support member and a plurality of nested support members, said nested support members being of a one or more sizes and being smaller than said main support member, each said nested support member being rotatably mounted on a larger support member so that the perimeter of said nested support member is adjacent to the perimeter of the support member on which it is mounted;

(b) a multiplicity of storage means for storing articles, said storage means supported by said support members;

(c) a main support member support means for supporting said main support members, each said main support member being rotatably mounted on said main support member support means;

(d) a drive means to rotate said support members, said drive means further comprising a drive shaft means, a multiplicity of idler wheel means, and a multiplicity of solenoid means whereby a single said drive shaft means is used to rotate said main support members and said nested support members.

19. A storage and retrieval unit according to claim 18 wherein said main support members are stacked to form a storage cylinder of independently rotatable said main support members.

* * * * *

UNITED STATES PATENT AND TRADEMARK OFFICE

CERTIFICATE OF CORRECTION

PATENT NO. : 5,337,920

DATED : August 16, 1994

INVENTOR(S) : Mark K. Clausen

It is certified that error appears in the above-indentified patent and that said Letters Patent is hereby corrected as shown below:

Column 4, line 36, change"oranges" to --openings--.
Column 4, line 37, change "allow" to --to allow--.
Column 6, line 23, change "basis" to --basic--.

Signed and Sealed this

Twenty-eight Day of March, 1995

*Attest:*

Bruce Lehman

BRUCE LEHMAN

*Attesting Officer*

*Commissioner of Patents and Trademarks*